US007517186B2

(12) United States Patent
Seitz et al.

(10) Patent No.: US 7,517,186 B2
(45) Date of Patent: Apr. 14, 2009

(54) CENTRIFUGAL PUMP AND CASING THEREFORE

(75) Inventors: Douglas W. Seitz, Eau Claire, WI (US); Michael C. Ruthy, Chippewa Falls, WI (US); Wayne Hable, Bloomer, WI (US)

(73) Assignee: W.S. Darley & Co., Chippewa Falls, WI (US)

( * ) Notice: Subject to any disclaimer, the term of this patent is extended or adjusted under 35 U.S.C. 154(b) by 389 days.

(21) Appl. No.: 11/424,572

(22) Filed: Jun. 16, 2006

(65) Prior Publication Data

US 2007/0292267 A1 Dec. 20, 2007

(51) Int. Cl.
*F04D 9/02* (2006.01)
*F04D 29/44* (2006.01)

(52) U.S. Cl. ..... 415/56.3; 415/204; 415/206; 415/208.3; 415/224

(58) Field of Classification Search ..... 415/56.1, 415/56.3, 83, 203, 204, 206, 208.3, 212.1, 415/224
See application file for complete search history.

(56) References Cited

U.S. PATENT DOCUMENTS 3,289,598 A * 12/1966 Buse et al. ..... 415/205
4,406,583 A 9/1983 Becker et al.
7,033,147 B2 4/2006 Yanai et al.

OTHER PUBLICATIONS

W.S. Darley, Drawing 205560, Jan. 11, 1994, United States.
W.S. Darley, Drawing 2053300, Sep. 26, 1986, United States.
Richard Edgar, International Search Report—Mailed Sep. 18, 2008, PCT/US07/13346, International Filing Date: Jun. 6, 2007.
Richard Edgar, Written Opinion of the International Search Authroity—Mailed Sep. 18, 2008, PCT/US07/13346, International Filing Date: Jun. 6, 2007.

* cited by examiner

*Primary Examiner*—Richard Edgar
(74) *Attorney, Agent, or Firm*—Anthony J. Bourget

(57) ABSTRACT

The present invention is directed to a pump casing and a centrifugal pump comprising a single piece casing, the casing comprising a first cut-water fluid flow path, a second cut-water fluid flow path, a first joint-water path, a second joint-water path, and an impeller cavity, the first cut-water fluid flow path and the second cut-water fluid flow path communicating with the first joint-water path and the second joint-water path, the pump further comprising an impeller positioned within the cavity, and a suction head overlaying the impeller. The first joint-water path communicates with a first discharge nozzle and the second joint-water path communicates with a second discharge nozzle, the first discharge nozzle and the second discharge nozzle situated substantially at opposing ends of the casing.

23 Claims, 9 Drawing Sheets

CENTRIFUGAL PUMP AND CASING THEREFORE

BACKGROUND OF THE INVENTION

1. Field of the Invention

The present invention relates generally to pumps and pump casings, and more specifically to casings for centrifugal pumps and pumps for use on emergency vehicles.

2. Background Information

Centrifugal pumps have been commonplace for ages, and have been used in numerous applications. The basic concept of a spinning impeller used to impart rotational forces coupled with a pump wall or volute to direct and increase the flow of a gas or fluid has spawned numerous useful products. Some of these products range from firefighting pumps to jet engines. Water-type pumps of many varieties use the centrifugal concept to generate a high pressure stream. Centrifugal pumps are particularly useful to the firefighting industry for producing high pressure flow and high flow rates to fight fires.

It is important to have versatile firefighting and emergency vehicles. One aspect of versatility is equipping such vehicles with high pressure outlets on either side of the vehicle. Such fire trucks have been around for decades. A midship fire truck, for instance, includes what is commonly known as a midship pump positioned relatively in the middle, or mid-ship, of the vehicle with outlets on either side. This allows the fire truck to park adjacent a fire hydrant or other source and conveniently connect to a water source from either side. Dual sided outlets also allow fluid from the vehicle to be pumped out either side for the convenience of delivery without having to turn around or greatly adjust the location of the vehicle. Dual outlets also allow for increased hook-ups to pump greater volume, if possible.

Midship pumps and other varieties of pumps, however, take up valuable space on an emergency vehicle. Providing a pump having a lower profile which takes up relatively little space would be an advantage so the unused space may be used for other important equipment or to construct a smaller vehicle for better maneuverability or other benefits. A smaller profile pump also accommodates for placement of the pump in a variety of areas on the vehicle, including, for instance, in the area under the cab portion of a vehicle (including the area beneath the rear passenger seat of a tilt-forward cab or cab-over-engine type of vehicle). Placement of a smaller profile pump in such area provides other benefits relating to overall design and overall systems design of such vehicles. Of course, such lower profile pumps must still satisfy the rigorous performance demands and outputs required by the industry.

The profile of a traditional firefighting pump is simply too large or awkward to be placed in an under-cab location of a vehicle without significant modification of the under-cab area and/or surrounding areas.

One example of a midship fire pump is shown with reference to FIG. 1 which depicts a Hale Type midship pump, manufactured by Hale Fire Pump Company, of Pennsylvania. FIG. 1 and detailed specifications pertaining to such pumps produced by Hale reveal the pump body 100 is horizontally split, on a single plane (represented generally by reference line 102), in two sections, an upper section generally shown with reference numeral 104, and a lower section generally shown with reference numeral 106. A stated purpose for these features is to accommodate easy removal of the entire impeller assembly including wear rings and bearings from beneath the pump without disturbing piping or the mounting of the pump in chassis. Detailed specifications further provide that the pump shall have one double suction impeller 108, and the pump body shall have two opposed discharge volute cutwaters 110 to eliminate radial unbalance.

As applicants understand the structure, the inner water path configuration of the pump shown in FIG. 1 is generally represented by the cut-away portion view shown in FIG. 2. Such water path structure allows for hookup to nozzles 112, 114 on both sides of the vehicle (vehicle not shown). It may be appreciated that closing of one nozzle 112 will result in all fluid output (i.e., output from each of the cut water areas) of the pump flowing to the opposing nozzle 114 or discharge valve (and vice versa). The discharge path 120 is configured so that closing one nozzle 112 or 114 (or opening only one of the nozzles 112, 114) will not close off fluid flow from either of the cut water paths 116, 118 of the centrifugal pump. A benefit of this path structure is to eliminate, or perhaps at least reduce, radial unbalance of the pump while accommodating outputs on either side of the vehicle. For instance, if fluid from one of the two cutwaters was otherwise not allowed to escape from a cut water path 116, 118, the rotational forces on the impeller would be out of balance which would tend to jeopardize the performance and life of the pump. One clear drawback of the above pump, however, is its large size, together with a relatively complicated water path structure and split design.

Accordingly, there is a need for a firefighting grade pump having a relatively modest profile so that the pump may occupy less area of a fire truck or other emergency vehicle, and where the pump includes nozzles on both sides of the truck. A modest profile is desired so that the pump may be located in the under-cab area of a vehicle. A simple single, non-split, casing design in which all water paths are located is also desired for ease of manufacture, hook-up and use. There is a need for such pump to be a powerful and reliable pump given the demands of the firefighting and emergency applications.

SUMMARY OF THE INVENTION

The present invention is directed to a pump casing, and preferably a single piece pump casing comprising a first cut-water fluid flow path, a second cut-water fluid flow path, a first joint-water path and a second joint-water path, the first cut-water fluid flow path and the second cut-water fluid flow path communicating with the first joint-water path and the second joint-water path. The first joint-water path communicates with a first discharge nozzle and the second joint-water path communicating with a second discharge nozzle, the first discharge nozzle and the second discharge nozzle situated substantially at opposing ends of the casing.

A further aspect of the invention includes a centrifugal pump comprising a single piece casing, the casing comprising a first cut-water fluid flow path, a second cut-water fluid flow path, a first joint-water path, a second joint-water path, the first joint-water path communicating with a first discharge nozzle and the second joint-water path communicating with a second discharge nozzle, the first discharge nozzle and the second discharge nozzle situated substantially at opposing ends of the casing, and an impeller cavity, the first cut-water fluid flow path and the second cut-water fluid flow path communicating with the first joint-water path and the second joint-water path, an impeller positioned within the cavity, and a suction head overlaying the impeller.

Yet a further aspect of the invention includes a centrifugal pump comprising at least one impeller contained within a casing, the casing comprising at least a first cut-water fluid flow path, at least a first discharge nozzle, and at least a second discharge nozzle, the first cut-water fluid flow path communicates with the first discharge nozzle and the second discharge nozzle, the first discharge nozzle and the second discharge nozzle situated substantially at opposing ends of the pump, at least one of the first discharge nozzle and the second discharge nozzle having a center output positioned substantially on a horizontal centerline of an impeller shaft of the impeller.

A further aspect of the present invention includes a centrifugal pump comprising at least one impeller for spinning in a first direction, a first cut-water fluid flow path, a second cut-water fluid flow path, and means for transporting in the first-direction fluid combined from the first cut-water fluid flow path and from the second cut-water fluid flow path.

A further aspect of the present invention includes a pump casing comprising a cut-water wall having an impeller side and a casing side, the casing side having a generally convex region, the impeller side of the wall in part defining a cut-water fluid flow path, the path further defined in part by the convex region of the wall, the path communicates with a first discharge nozzle and a second discharge nozzle, the first and the second discharge nozzles situated substantially at opposing ends of the casing.

Yet a further aspect of the present invention includes a centrifugal pump comprising a casing having a first cut-water fluid flow path, the casing further having a cut-water wall in part defining a second cut-water fluid flow path, the first and second cut-water fluid flow paths combining to form a first joint-water path, the first joint-water path spanning at least 135 degrees from a trailing edge of the cut-water wall to a discharge outlet of the casing. The pump of the present invention includes such pumps for use in a vehicle and particularly for use in a fire truck of the tilt-forward cab variety having an area located below the truck crew cab.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
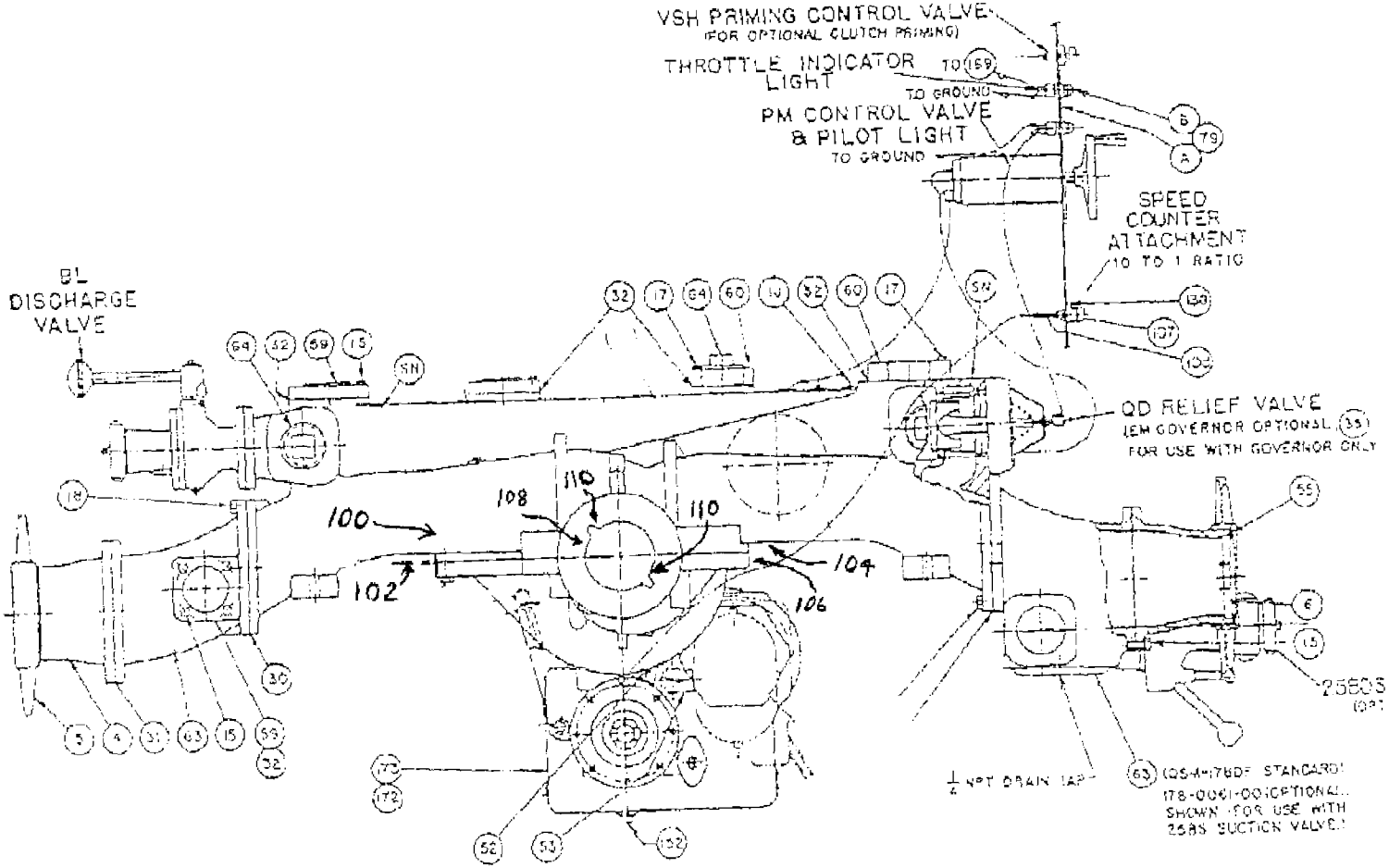
FIG. 1 (PRIOR ART)
FIG. 1 is an elevation view of a prior art pump.
Figure 2:
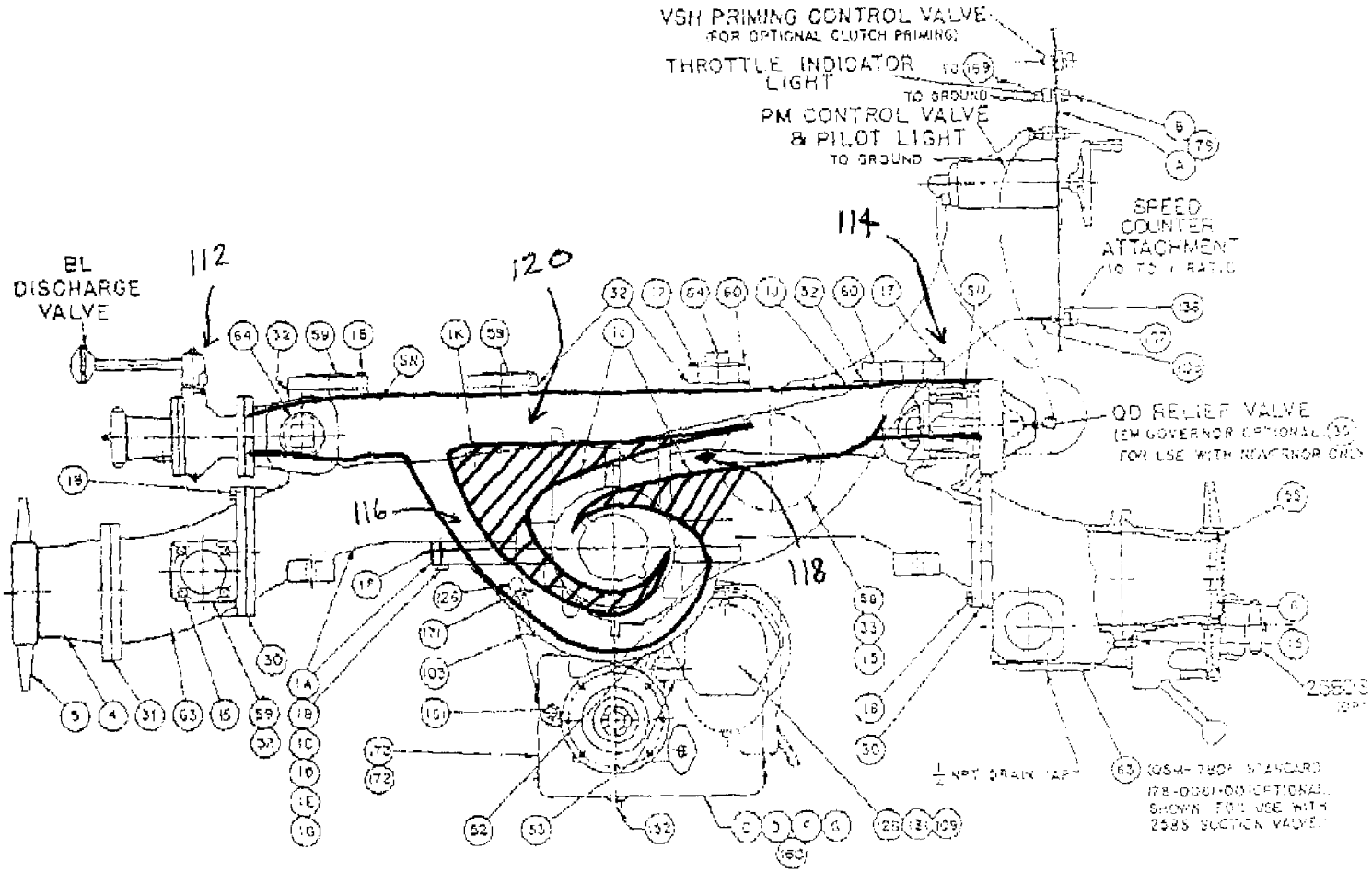
FIG. 2 (PRIOR ART)
FIG. 2 is an elevation view of the pump of FIG. 1 having a cut-away portion.

While the invention is amenable to various modifications and alternative forms, specifics thereof have been shown by way of example in the drawings and will be described in detail. It should be understood, however, that the intention is not necessarily to limit the invention to the particular embodiments or aspects described. On the contrary, the intention is to cover all modifications, equivalents, and alternatives falling within the spirit and scope of the invention and as defined by the appended claims.

DESCRIPTION OF THE EMBODIMENTS

Figure 3:
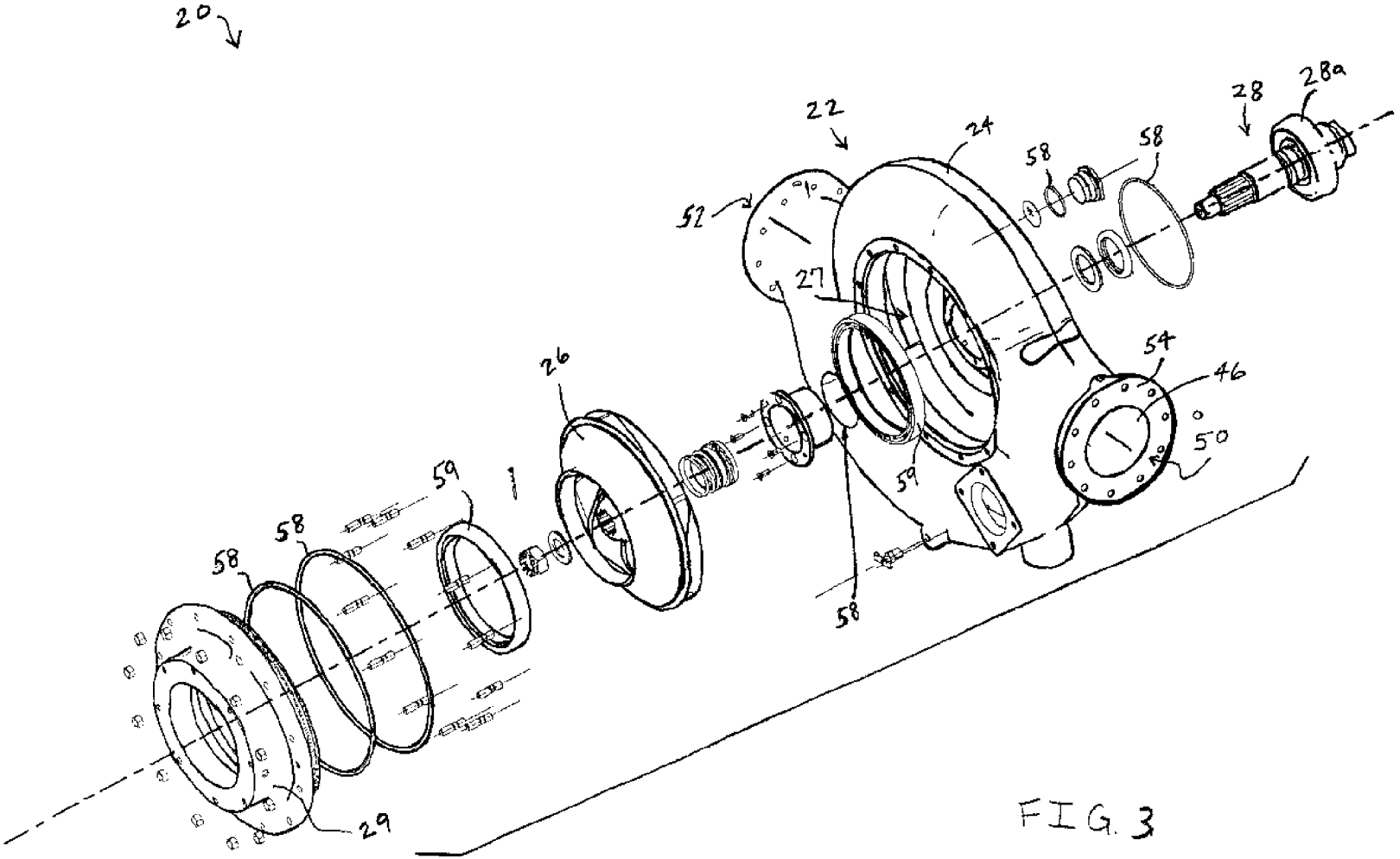
FIG. 3 is an exploded perspective view of a pump in accordance with the present invention.
Figure 4:
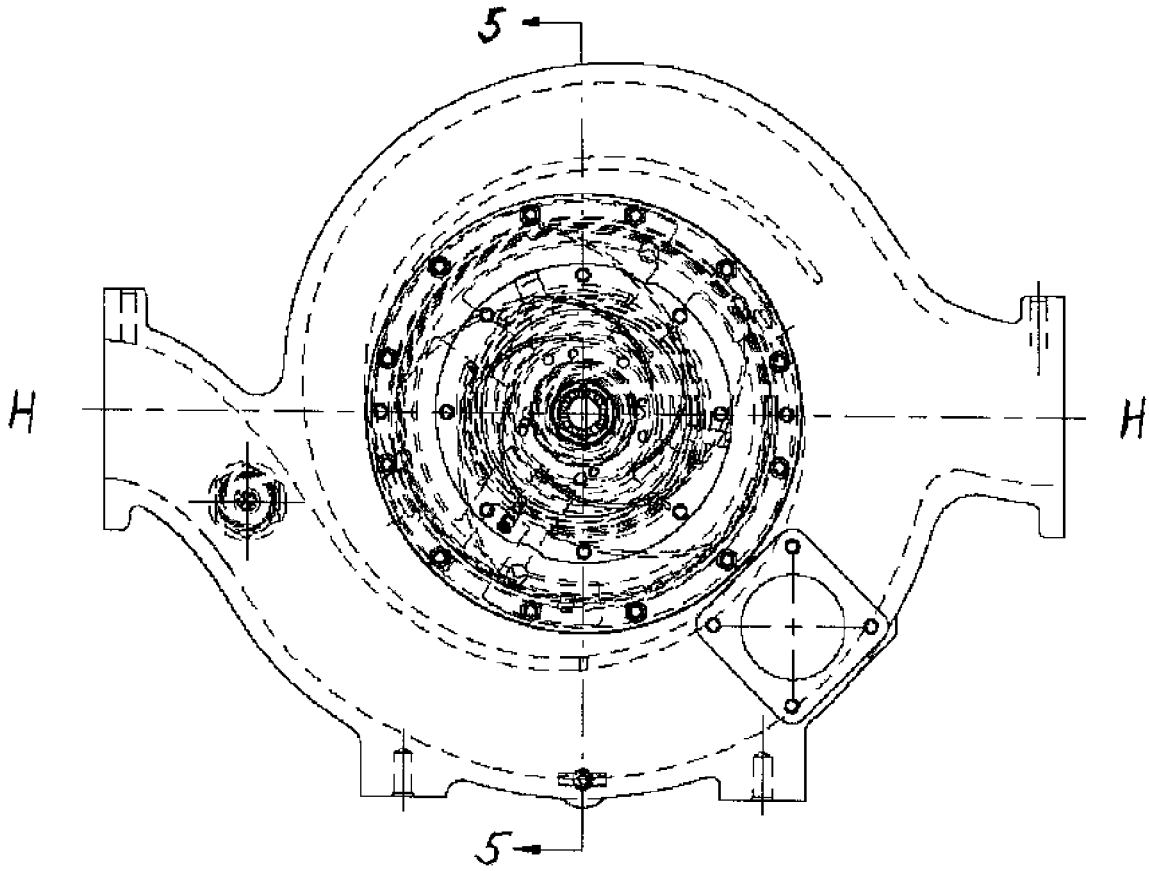
FIG. 4 is an elevation view of the pump shown in FIG. 3.
Figure 5:
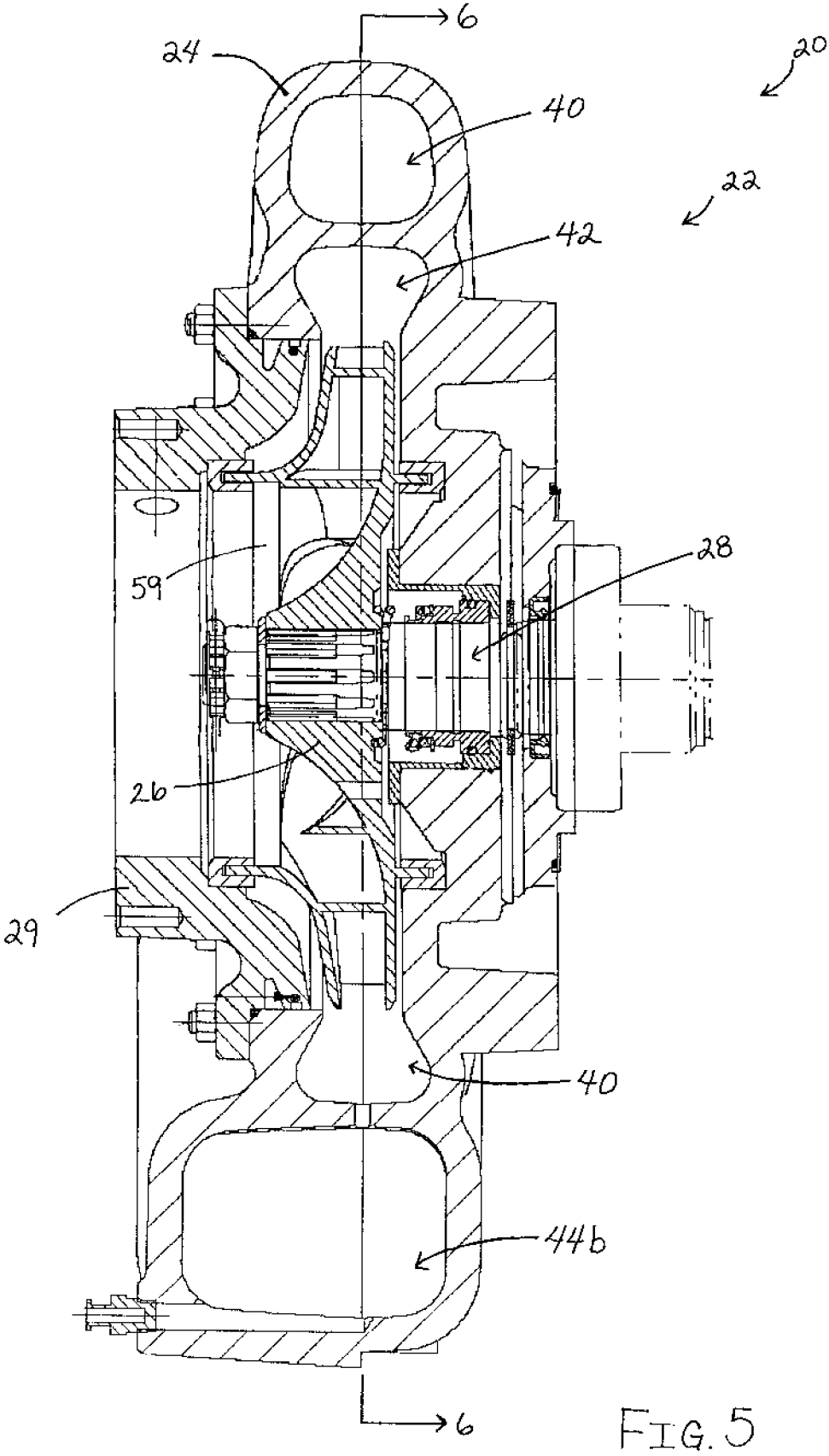
FIG. 5 is a section view taken along line 5-5 of FIG. 4.

Referring to FIGS. 3-6, a pump according to the present invention is generally depicted with reference to numeral 20. In one aspect, pump 20 includes a casing 22 which is preferably a single piece metal casting. With reference to FIG. 3, casing 22 includes an outer casing wall 24. Casing wall 24 is preferably generally circular, and defines an impeller cavity 27 in which is positioned an impeller 26. Impeller drive shaft 28 runs through cavity 27 and secures impeller 26 to drive the impeller 26. A suction head 29 overlays impeller 26. Fluid is introduced through head 29 and into impeller 26 for subsequent discharge through discharge nozzles 46, 48. Pump 20 further includes O rings 58, seal rings 59 and other common pump hardware as generally shown.

Figure 6:
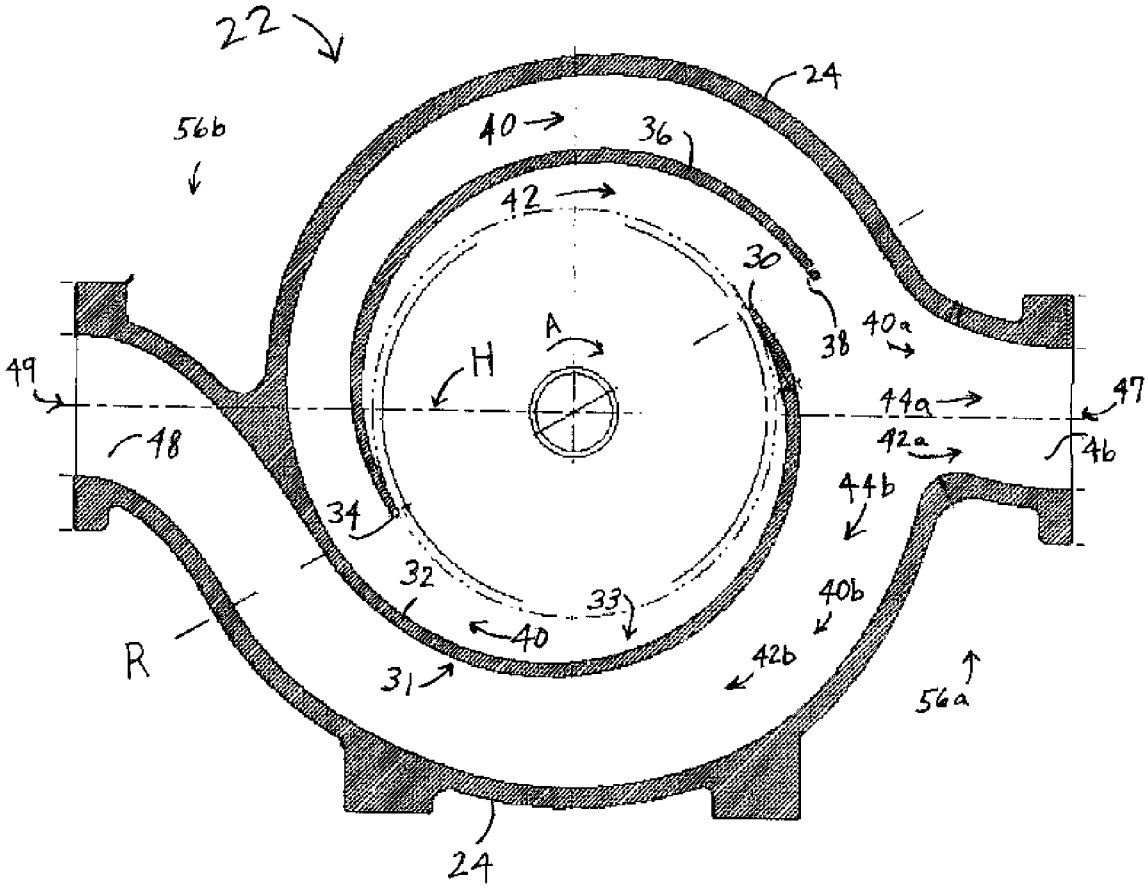
FIG. 6 is a section view taken along line 6-6 of FIG. 5 with portions of the pump removed for clarity.

With particular reference to FIG. 6, casing 20 includes a first cut-water wall 32 having a first cut-water 30 disposed at an end thereof. First cut-water wall 30 includes an impeller side 33 having a generally concave configuration, and a casing side 31 having a generally convex configuration. First cut-water wall 32 in part defines first cut-water fluid flow path 40. As fluid exits spinning impeller 26 the fluid travels along first cut-water fluid flow path 40. Subsequent flow of the fluid within path 40 is described further below.

Preferably casing 22 includes second cut-water wall 36 having a second cut-water 34 disposed at one end thereof and a trailing end 38 disposed at another end thereof. Second cut-water wall 36 in part defines second cut-water fluid flow path 42. As fluid exits spinning impeller 26 the fluid travels along second cut-water fluid flow path 42. Subsequent flow of the fluid within path 42 is described further below.

First cut-water fluid flow path 40 and second cut-water fluid flow path 42 communicate to join into a first joint water path 44*a* and a second joint water path 44*b*. Casing 22 further includes a first discharge nozzle 46 and a second discharge nozzle 48. Both first path 40 and second path 42 communicate with first discharge nozzle 46 and second discharge nozzle 48. Both first joint water path 44*a* and second joint water path 44*b* communicate with first discharge nozzle 46 and second discharge nozzle 48. Preferably, first discharge nozzle 46 and second discharge nozzle 48 are situated substantially at opposing ends 56*a*, 56*b* of casing 22. More preferably discharge nozzles 46, 48 have a center output 47, 49 positioned substantially on a horizontal centerline H of casing 22. More particularly, horizontal centerline H runs through the horizontal center of impeller drive shaft 28. Alignment of nozzles 46, 48 accommodates for efficient dual outlets to be extended to both sides of an emergency vehicle and for achieving a lower profile pump 20 for space saving applications. Alignment of nozzles 46, 48 about the horizontal centerline H also accommodates for a lower profile pump 20 for space savings.

In operation, fluid from path 40 continues to circulate through casing 22. Particularly, a portion of fluid travels along first cut-water fluid flow path 40*a* to exit at discharge nozzle 46, and a portion travels along first cut-water fluid flow path 40*b* to exit at discharge nozzle 48. Likewise, fluid from path 42 continues to circulate through casing 22. Particularly, a portion of fluid travels along second cut-water fluid flow path 42*a* to exit at discharge nozzle 46, and a portion travels along second cut-water fluid flow path 40*b* to exit at discharge nozzle 48. Joint water path 44*a* includes both first path 40*a* and second path 42*a*, and joint water path 44*b* includes both first path 40*b* and second path 42*b*. It may be appreciated that at least a portion of path 40 and at least a portion of path 42 define path 40*b* to create joint water path 44*b*. As such, both the impeller side 33 and casing side 31 of wall 32 in part define first cut-water fluid flow path 40. First cut-water wall 32 defines in part flow path 40 and defines in part second joint-water path 44*b*. Having joint-water path 44*b* allows pump 20 to efficiently deliver fluid to ends 56*a*, 56*b* in a low profile arrangement. While other pump designs may deliver fluid to both ends of a vehicle, joint-water path 44*b* contained entirely within casing 22 achieves an efficient low profile arrangement. As a single casting, casing 22 also accommodates for efficient assembly of pump 20 and positioning and connecting within a vehicle.

Importantly, joint-water path 44*b* allows for efficient operation of pump especially where an operator desires to vary the fluid output through respective discharge nozzles 46, 48. For instance, a user may close off fluid flow through nozzle 46 without disrupting radial balance of impeller 26, since the entire output from flow path 40 and flow path 42 would then be directed through nozzle 48. Likewise, if a user were to close fluid flow through nozzle 48, the output from flow path 40 and flow path 42 would then be directed through nozzle 46. If respective nozzles 46, 48 were to be otherwise fed directly from respective flow paths without the combining of fluid in a joint water path, radial forces would disrupt the balance of impeller 26 impacting performance and pump life.

In operation, impeller 26 spins in a first radial direction represented generally by arrow A. While arrow A depicts a clock-wise direction, it may be appreciated that pump 20 may be designed for impeller 26 to spin in a counter clock-wise direction. The first-direction spinning impeller 26 releases fluid into paths 40, 42. Pump 20 includes means for continuing transporting fluid in the first direction. Means for transporting is generally represented by reference numeral 44*b*, which may include means such as second joint-water path 44*b*, first cut-water fluid flow path 40*b*, and second cut-water fluid flow path 42*b*. Preferably, means 44*b* has a generally arch-like configuration, or lies generally along a radius or modified radius. Preferably means for transporting includes a joint-water path spanning substantially from a first end 56*a* to a second end 56*b* of the pump 20. Preferably means 44*b* spans from adjacent trailing edge 38 to first discharge outlet 46 and continues to span to second discharge outlet 48. Preferably means for continuing transporting is contained entirely within single piece casing 22. Providing a simple single, non-split, casing design in which all water paths are located (including means for continuing transportation, such as path 44*b* which curves to either side of the casing) allows for ease of manufacture, hook-up, and use. It may be appreciated that connections to the nozzles of the pump may likewise be confined to a modest space to achieve an overall low profile solution.

For pump 20 to accommodate dual output at discharge nozzles 46, 48, pump 20 preferably includes joint-water path 44*b* which spans at least 45 degrees, and more preferably at least 135 degrees, and even more preferably at least 180 degrees, and most preferably, greater than 180 degrees. It may be appreciated that having joint-water path 44*b* span at least 135 degrees accommodates for joint-water path 44*b* to wrap back or span to a significant degree, and which accommodates a lower profile casing and provides meaningful spacing of respective outputs or nozzles 46, 48. The joint-water path 44*b* spans in a curving manner along an arch generally defined by an arch line spanning from trailing edge 38 to discharge outlet 48. It may be appreciated that arch line is a curving centerline of joint-water path 44*b*. As shown in FIG. 6, joint-water path 44*b* may commence adjacent trailing edge 38 and follow radially in direction A to discharge nozzle 48. Preferably trailing edge 38 aligns substantially along reference line R. Preferably cut-water 30 also preferably substantially aligns along reference line R. Reference line R is a centerline running through impeller shaft 28. It may be appreciated that joint-water path 44*b* spans approximately 180 degrees from trailing edge 38 to reference line R. Preferably joint-water path 44*b* spans greater than 180 degrees to accommodate configuration of discharge nozzles being positioned at substantially opposite ends 56*a*, 56*b*. Preferably, joint water path 44*b* spans at least across horizontal centerline H.

Figure 7:
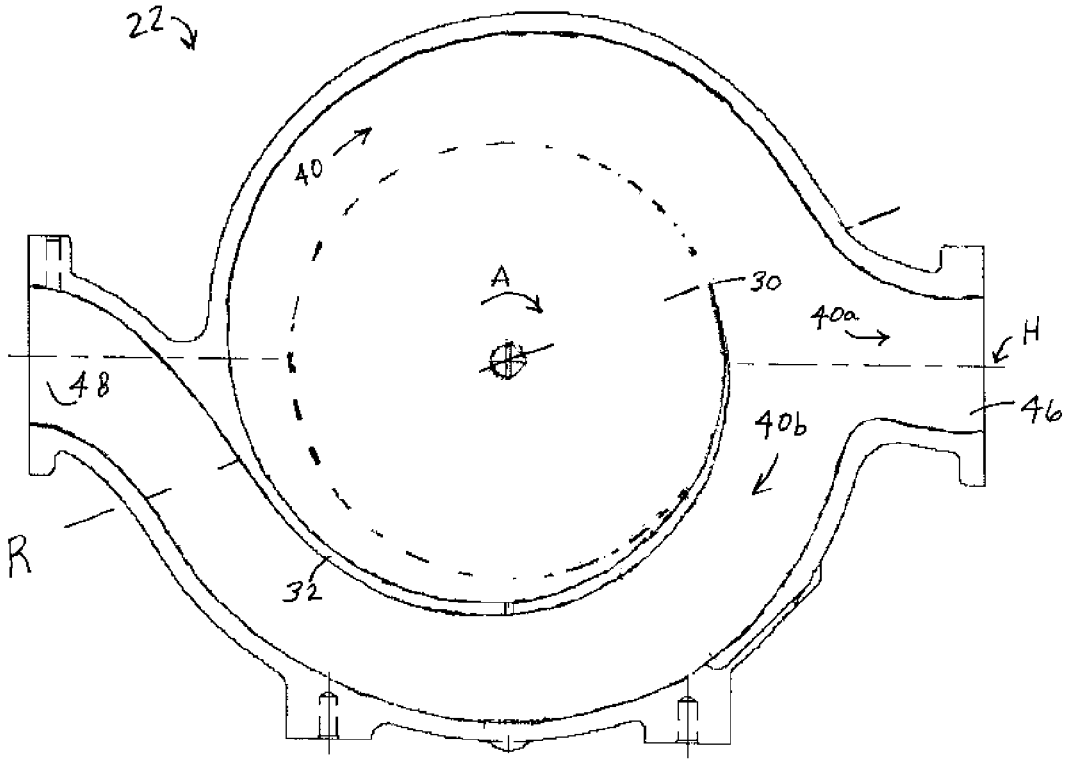
FIG. 7 is a section view of a further aspect of the present invention with portions of the pump removed for clarity.

A further aspect of the invention is shown with reference to FIG. 7 which depicts a casing 22 having a single cut-water 30. Cut-water wall 32 in part defines cut-water fluid flow path 40. Path 40 communicates with first discharge nozzle 46 and second discharge nozzle 48. Preferably nozzle 46 is positioned substantially opposite nozzle 48, and at least one and preferably both nozzles 46, 48 are positioned with a center output lying substantially on horizontal centerline H.

Figure 8:
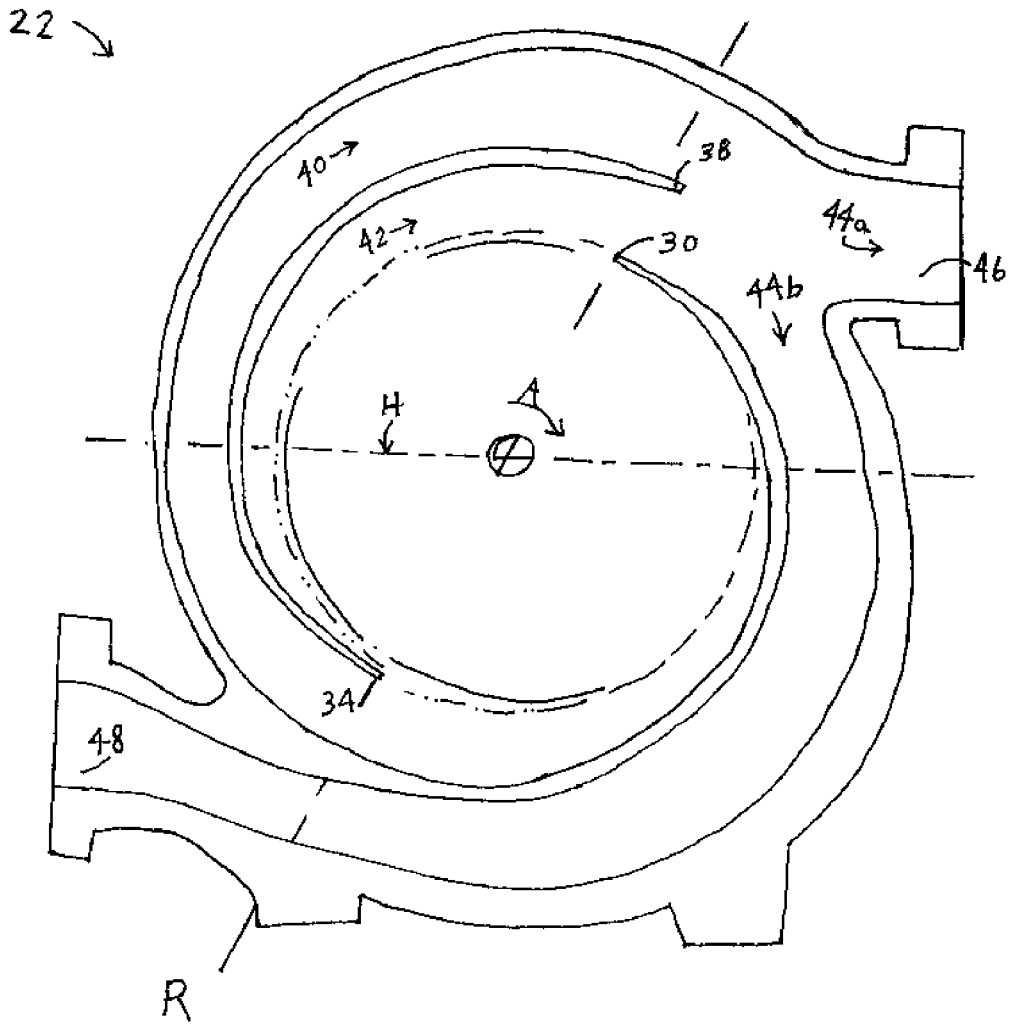
FIG. 8 is a section view of a further aspect of the present invention with portions of the pump removed for clarity.

A further aspect of the invention is shown with reference to FIG. 8 which depicts a casing 22 having a cut waters 30, 34. Nozzles 46, 48 may be off-set from horizontal centerline H. The positioning of cut waters 30, 34 may also vary as desired.

Figure 9:
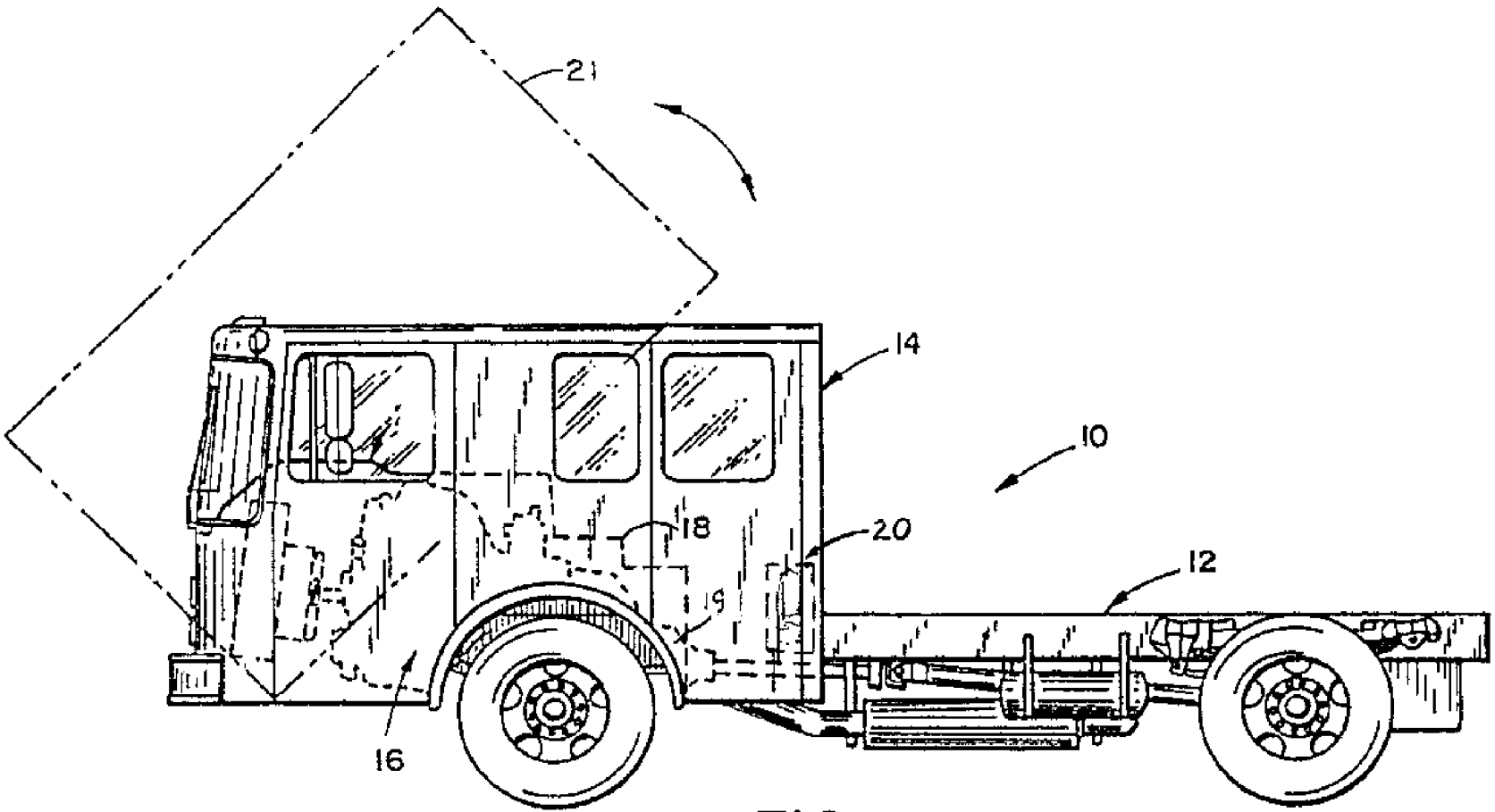
FIG. 9 is a side elevation view of a truck having a pump in accordance with the present invention.

Referring to FIG. 9, there is shown one example of a vehicle relating to the present invention and particularly a cab-over-engine type truck 10 having a longitudinally extending chassis 12, a cab 14 mounted generally above the front end of the chassis, and an internal combustion engine 16 mounted to the chassis generally within the cab and below the floor 18 of the cab. The cab extends rearwardly beyond the engine 16 and transmission 19. The front of the cab 14 is mounted to the chassis on hinges which allow the cab to be tilted forward, as shown in broken lines at 21, to allow full access to the engine and other items such as pump 20 under the cab when servicing of the engine or pump as needed. Pump 20 may be positioned under the cab as shown or generally about a desired or convenient region under cab 14.

While the present invention has been described with reference to several particular example embodiments, those skilled in the art will recognize that many changes may be made thereto without departing from the spirit and scope of the present invention, which is set forth in the following claims.

What is claimed is:

1. A single piece pump casing comprising:

a first cut-water fluid flow path, a second cut-water fluid flow path, a first joint-water path and a second joint-water path, said first cut-water fluid flow path and said second cut-water fluid flow path communicating with said first joint-water path and said second joint-water path, said first joint-water path communicating with a first discharge nozzle and said second joint-water path communicating with a second discharge nozzle, said first discharge nozzle and said second discharge nozzle situated substantially at opposing ends of said casing.

2. The pump casing of claim 1 wherein a first cutwater wall defines in part said first cut-water fluid flow path and defines in part said second joint-water path.

3. The casing of claim 1 wherein the entirety of said first cut-water fluid flow path and of said second cut-water fluid flow path are contained within said single piece casing, said casing having a generally circular shape.

4. The casing of claim 1 wherein at least one of said first discharge nozzle and said second discharge nozzle has a center output positioned substantially on a horizontal centerline of said casing.

5. A centrifugal pump comprising;

a single piece casing, said casing comprising a first cut-water fluid flow path, a second cut-water fluid flow path, a first joint-water path, a second joint-water path, and an impeller cavity, said first cut-water fluid flow path and said second cut-water fluid flow path communicating with said first joint-water path and said second joint-water path, said first joint-water path communicating with a first discharge nozzle and said second joint-water path communicating with a second discharge nozzle, said first discharge nozzle and said second discharge nozzle situated substantially at opposing ends of said casing;

an impeller positioned within said cavity; and a suction head overlaying said impeller.

6. The pump of claim 5 wherein said first cut-water fluid flow path communicates with said first discharge nozzle and said second discharge nozzle.

7. The pump of claim 5 wherein at least one of said first discharge nozzle and said second discharge nozzle has a center output positioned substantially on a horizontal centerline of said impeller.

8. The pump of claim 5 wherein a first cut-water wall defines in part said first cut-water fluid flow path and defines in part said second joint-water path.

9. The pump of claim 8 wherein said casing has a generally circular casing wall and wherein said first cut-water wall and said casing wall define said second joint-water path.

10. The pump of claim 5 comprising at least two impellers.

11. A centrifugal pump comprising:

at least one impeller contained within a casing, said casing comprising at least a first cut-water fluid flow path, at least a first discharge nozzle, and at least a second discharge nozzle, said first cut-water fluid flow path communicates with said first discharge nozzle and said second discharge nozzle, said first discharge nozzle and said second discharge nozzle situated substantially at opposing ends of said pump, at least one of said first discharge nozzle and said second discharge nozzle having a center output positioned substantially on a horizontal centerline of an impeller shaft of said impeller.

12. The pump of claim 11 wherein said casing is a single piece casing and includes a second cut-water fluid flow path, said second cut-water fluid flow path communicates with said first discharge nozzle and said second discharge nozzle.

13. A centrifugal pump comprising:

at least one impeller for spinning in a first direction;

a first cut-water fluid flow path;

a second cut-water fluid flow path;

means for transporting in said first-direction fluid combined from said first cut-water fluid flow path and from said second cut-water fluid flow path, said means for transporting fluid including a joint-water path spanning substantially from a first end of said pump to a second end of said pump, and where said joint water path communicates with a discharge nozzle, said discharge nozzle having a center output positioned substantially on a horizontal centerline of an impeller shaft of said impeller.

14. The pump of claim 13 wherein said means for transporting fluid has a generally arch-like configuration.

15. The pump of claim 13 wherein said first cut-water fluid flow path and said second cut-water fluid flow path are entirely contained within a single piece casing of said pump and wherein said means for transporting fluid is contained within said casing.

16. The pump of claim 13, further comprising:

means for transporting in a second-direction fluid combined from said first cut-water fluid flow path and from said second cut-water fluid flow path.

17. A single piece pump casing comprising:

a cut-water wall having an impeller side and a casing side, said casing side having a generally convex region, said impeller side of said wall in part defining a cut-water fluid flow path, said path further defined in part by said convex region of said wall, said path communicates with a first discharge nozzle and a second discharge nozzle, said first and said second discharge nozzles situated substantially at opposing ends of said casing.

18. The casing of claim 17 wherein at least one of said first discharge nozzle and said second discharge nozzle has a center output positioned substantially on a horizontal centerline of said casing.

19. The casing of claim 17 wherein at least a portion of said path and a second cut-water fluid flow path further define said path to create a joint-water path.

20. The casing of claim 17 wherein said first discharge nozzle is oriented to discharge fluid in a direction substantially opposite said second discharge nozzle.

21. A centrifugal pump comprising:

a casing having a first cut-water fluid flow path, said casing further having a cut-water wall in part defining a second cut-water fluid flow path, said first and second cut-water fluid flow paths combining to form a first joint-water path, said first joint-water path spanning at least 135 degrees from a trailing edge of said cut-water wall to a discharge outlet of said casing, and where said first and second cut-water fluid flow paths combine to form a second joint-water path, said first joint water oath communicates with a first discharge nozzle and said second joint-water oath communicates with a second discharge nozzle, said first and second discharge nozzles situated substantially at opposite ends of said casing.

22. The pump of claim 21 wherein said first joint-water path spans greater than 180 degrees along a curve generally defined by an arch line spanning from a trailing edge of said cut-water wall to a discharge outlet of said casing.

23. A pump for use in a fire truck of the tilt-forward cab variety having an area located below the truck crew cab, said pump comprising:

a casing having a first cut-water fluid flow path, said casing further having a cut-water wall in part defining a second cut-water fluid flow path, said first and second cut-water fluid flow paths combining to form a first joint-water path, said first joint-water path spanning at least 135 degrees from a trailing edge of said cut-water wall to a discharge outlet, and where said joint water oath communicates with a discharge nozzle, said discharge nozzle having a center output positioned substantially on a horizontal centerline of an impeller shaft of said impeller.

* * * * *